US009851672B2

(12) United States Patent
Itoh

(10) Patent No.: US 9,851,672 B2
(45) Date of Patent: Dec. 26, 2017

(54) IMAGE FORMING APPARATUS THAT ADJUSTS IMAGE FORMING CONDITIONS

(71) Applicant: CANON KABUSHIKI KAISHA, Tokyo (JP)

(72) Inventor: Isami Itoh, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/277,367

(22) Filed: Sep. 27, 2016

(65) Prior Publication Data

US 2017/0108809 A1 Apr. 20, 2017

(30) Foreign Application Priority Data

Oct. 19, 2015 (JP) ..... 2015-205839

(51) Int. Cl.
*G03G 15/00* (2006.01)
*G03G 15/16* (2006.01)

(52) U.S. Cl.
CPC ..... *G03G 15/5054* (2013.01); *G03G 15/1605* (2013.01)

(58) Field of Classification Search
CPC ..... G03G 15/5058; G03G 15/5054; G03G 15/1605
USPC ..... 399/49
See application file for complete search history.

(56) References Cited

U.S. PATENT DOCUMENTS 6,658,221 B2 12/2003 Hama et al.
2013/0051827 A1* 2/2013 Fukumuro ..... G03G 15/5058 399/49
2013/0201497 A1* 8/2013 Iwanami ..... G03G 15/5058 358/1.9
2014/0119755 A1* 5/2014 Shida ..... G03G 15/5058 399/49

FOREIGN PATENT DOCUMENTS

JP 2002-214855 A 7/2002

* cited by examiner

*Primary Examiner* — Sophia S Chen
(74) *Attorney, Agent, or Firm* — Fitzpatrick, Cella, Harper & Scinto

(57) ABSTRACT

An image forming apparatus forms a measurement image, controls a sensor to measure light reflected from a first area of an intermediate transfer member, controls the sensor to measure light reflected from a measurement image, and controls the sensor to measure light reflected from a second area of the intermediate transfer member. The apparatus determines first information relating to a tendency of the measurement results of the first area, determines second information relating to a tendency of the measurement results of the second area, and selects a computational equation for computing a correction value of a measurement result of the measurement image. The apparatus generates a correction value. The apparatus adjusts an image forming condition.

11 Claims, 7 Drawing Sheets

IMAGE FORMING APPARATUS THAT ADJUSTS IMAGE FORMING CONDITIONS

BACKGROUND OF THE INVENTION

Field of the Invention

The present invention relates to an electrophotographic image forming apparatus that is used in devices such as copiers and printers.

Description of the Related Art

Image forming apparatuses employing an electrophotographic system or the like form an image pattern for tone correction on an intermediate transfer belt, detect the density of the image pattern, and perform tone correction based on the detected density. The surface wears with usage of the intermediate transfer belt, and unevenness occurs in the reflectance of the surface. This unevenness may also increase due to multilayering of a surface coat of the intermediate transfer belt. Since such unevenness affects the detected density of the image pattern, the accuracy of tone correction may be lowered.

U.S. Pat. No. 6,658,221 proposes creating a profile by sampling light reflected from the surface of an intermediate transfer belt on which a toner image is not formed, throughout one turn of the intermediate transfer belt, and using the profile to correct the detected density (amount of reflected light) of the image pattern.

Using the invention of U.S. Pat. No. 6,658,221 enables tone correction to be performed with high accuracy. However, the profile data for five turns of the intermediate transfer belt needs to be obtained. Since the user cannot form images during this period, so-called downtime occurs. A storage device for storing one turn worth of profile data is also required.

SUMMARY OF THE INVENTION

The present invention also reduces storage capacity together with reducing the time required for tone correction.

The present invention provides an image forming apparatus comprising the following elements. An image forming unit is configured to form an image. An intermediate transfer member is configured to have the image transferred thereto and to convey the image. A sensor is configured to measure light reflected from the intermediate transfer member. A controller is configured to control the image forming unit to form a measurement image, to control the sensor to measure light reflected from a first area of the intermediate transfer member, to control the sensor to measure light reflected from the measurement image, and to control the sensor to measure light reflected from a second area of the intermediate transfer member. A selection unit is configured to determine, from a plurality of measurement results of the first area, first information relating to a tendency of the measurement results of the first area, to determine, from a plurality of measurement results of the second area, second information relating to a tendency of the measurement results of the second area, and to select a computational equation for computing a correction value of a measurement result of the measurement image from among a plurality of computational equations, based on the first information and the second information. A generation unit is configured to generate the correction value from the measurement results of the first area and the measurement results of the second area, based on the computational equation selected by the selection unit. An adjustment unit is configured to adjust an image forming condition from the correction value generated by the generation unit and the measurement result of the measurement image. The first area corresponds to an area, on an upstream side of the measurement image in a conveyance direction in which the intermediate transfer member conveys the image, in which the measurement image is not formed. The second area corresponds to an area, on a downstream side of the measurement image in the conveyance direction, in which the measurement image is not formed.

Further features of the present invention will become apparent from the following description of exemplary embodiments (with reference to the attached drawings).

DESCRIPTION OF THE EMBODIMENTS

Overall Configuration of Image Forming Apparatus

Figure 1:
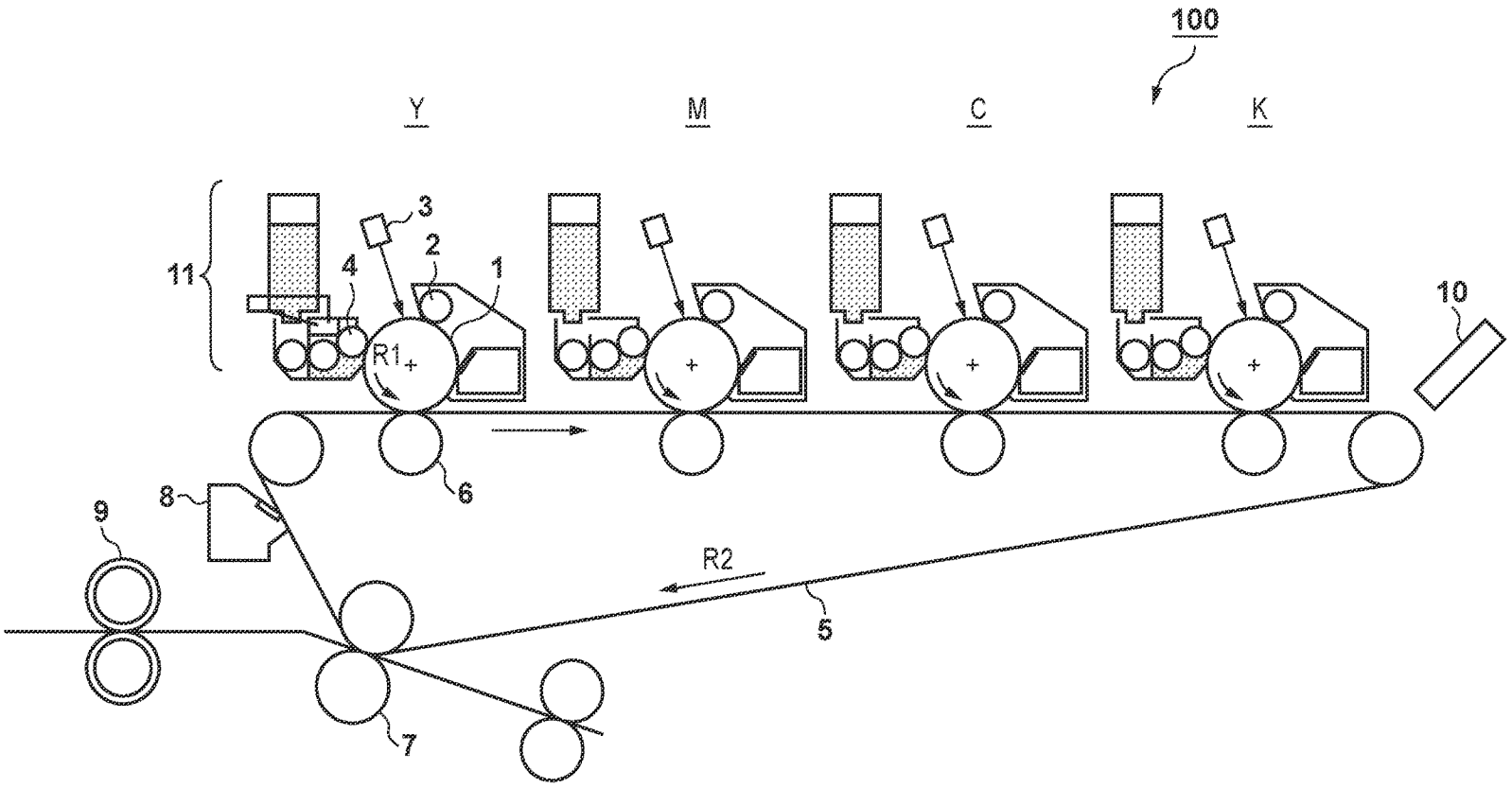
FIG. 1 is cross-sectional view of an image forming apparatus.

FIG. 1 is a schematic cross-sectional view of an image forming apparatus 100. The image forming apparatus 100 is a copier that is able to form an image on a sheet (recording paper, OHT sheet, fabric, resin, etc.) using an electrophotographic system. The image forming apparatus 100 may also be a printer or a facsimile machine.

The image forming apparatus 100 has first, second, third and fourth image forming parts (stations) for respectively forming yellow (Y), magenta (M), cyan (C) and black (K) images, as image forming units that form toner images. The configurations of the image forming parts are the same except for the color of the toner that is used. Thus, reference signs have been given to only the image forming part 11 for yellow in FIG. 1.

In the image forming part 11, a photosensitive drum 1, which is a cylindrical photosensitive member, is provided as an image carrier. The photosensitive drum 1 rotates in the direction of an arrow R1. The surface of the photosensitive drum 1 is charged to a uniform potential by a charging roller 2 that serves as a charging unit. A laser beam scanner 3 that serves as an exposure unit irradiates the surface of the photosensitive drum 1 with a light beam that depends on image data, and forms an electrostatic latent image. A developing device 4 that serves as a developing unit develops the electrostatic latent image into a toner image (visible image) by adhering toner thereto. Primary transfer of the toner image is performed to an intermediate transfer belt 5 by a primary transfer roller 6. The intermediate transfer belt 5 is an endless belt, and functions as an image carrier and the intermediate transfer member that carries and conveys the toner image. The intermediate transfer belt 5 rotates in the direction shown with an arrow R2. Secondary transfer of the toner image formed on the intermediate transfer belt 5 is performed to a sheet by secondary transfer rollers 7. Toner remaining after the secondary transfer is removed from the surface of the intermediate transfer belt 5 by a cleaning apparatus 8 that serves as a cleaning unit. In the case where the cleaning apparatus 8 has a blade that removes toner by coming in contact with the surface of the intermediate transfer belt 5, the surface of the intermediate transfer belt 5 gradually wears. This wear may cause unevenness of the reflectance of the surface of the intermediate transfer belt 5. The toner image that has undergone secondary transfer to the sheet is fixed on the sheet by a fixing apparatus 9. Note that the sheet may be referred to as a recording medium, a recording material, paper, transfer paper, a transfer material or a transfer medium. A sensor 10 is a sensor that detects the amount (optical density) of light reflected from the surface of the intermediate transfer belt 5, and detects the amount (optical density) of light reflected from toner images formed on the surface of the intermediate transfer belt 5. The sensor 10 has a light emitting element and a light receiving element. The light emitting element irradiates light toward the image carrier. Note that a mirror or the like may be included between the light emitting element and the image carrier. Types of reflected light include specularly reflected light and diffusely reflected light, and the sensor 10 is assumed to be disposed such that the light receiving element of the sensor 10 receives specularly reflected light. The sensor 10 may also be referred to as an optical sensor or a photo sensor. The sensor 10 thus functions as a measurement unit that irradiates light toward the image carrier and measures light reflected from the image carrier.

Image Processing Part

Figure 2:
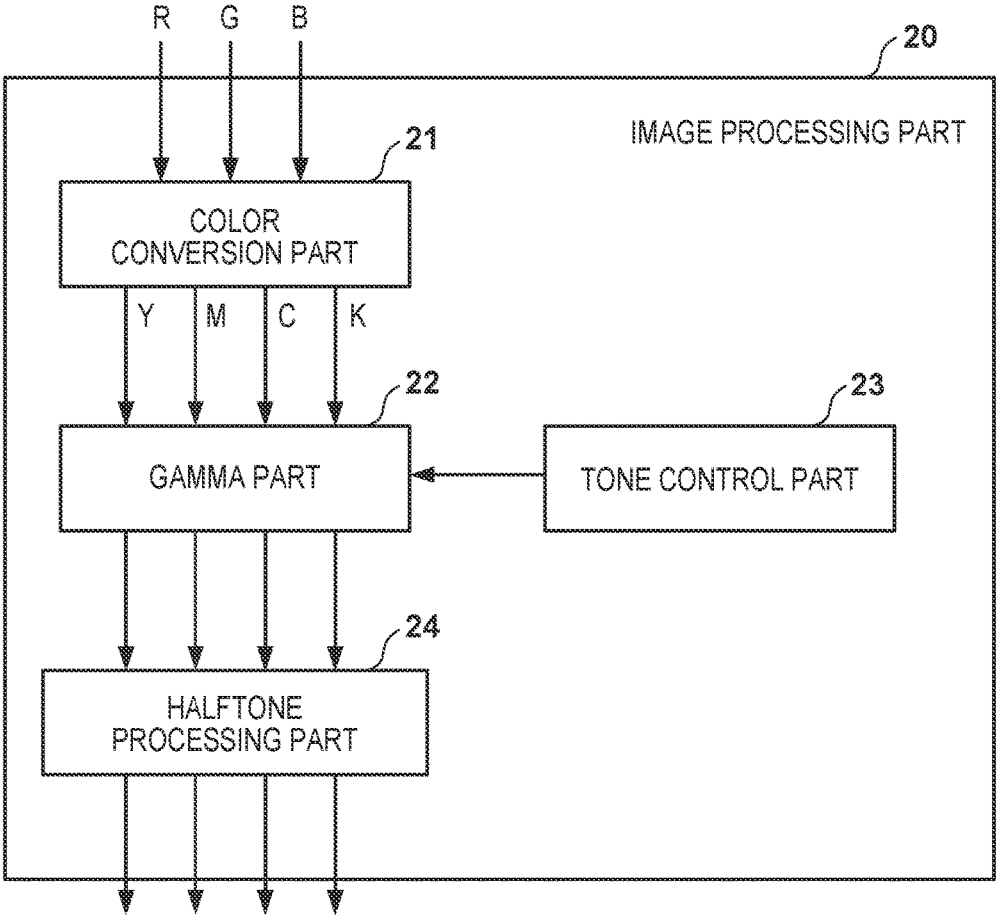
FIG. 2 is a block diagram of an image processing part.

As shown in FIG. 2, an image processing part 20 is a unit that converts image data input from an image scanner or a host computer into image data for image formation. A color conversion part 21 converts the color space of input image data into the color space of the image forming part 11. For example, input image data in RGB format or YUV format is converted into YMCK image data. A gamma part 22 is a unit that performs tone correction of the YMCK image data output from the color conversion part 21 in accordance with a tone correction condition. For example, the gamma part 22 uses a gamma look-up table, which is a tone correction condition set by a tone control part 23, and corrects the tone properties of the input YMCK image data. Note that the gamma look-up table is a conversion condition for converting image data, and the gamma part 22 is an example of a conversion unit that converts image data based on the conversion condition. The tone correction condition is created in advance such that the tone properties of the input image data and the tone properties of the toner image formed on the sheet by the image forming apparatus 100 generally match. The tone properties of the original are thereby reproduced in the copy. The tone properties of the image forming part 11 change according to factors such as usage, ambient temperature, and the basis weight of the sheet. Thus, the gamma look-up table is updated or created according to these factors. The image forming part 11 is an example of an image forming unit that forms images based on the image data converted by the gamma part 22. A halftone processing part 24 is a unit that binarizes the YMCK image data that is output from the gamma part 22. The halftone processing part 24 binarizes the image data using processing such as dithering. The Y image data, the M image data, the C image data and the K image data output from the halftone processing part 24 are respectively supplied to corresponding laser beam scanners 3.

Test Image

The tone control part 23 causes the image forming part 11 to create a toner image for tone correction (also referred to as a test image, image pattern, patch image or simply a patch), causes the sensor 10 to detect the toner image, and corrects the look-up table based on the detection result. In other words, the tone control part 23 creates, updates or corrects the look-up table so that the tone properties of the test image and the tone properties detected by the sensor 10 generally match. The tone properties may also be referred to as the density properties of the toner image. The tone control part 23 thus functions as a control unit that causes the image forming part 11 to form a measurement image on the image carrier, and causes the sensor 10 to measure light reflected from the image carrier on which the measurement image was formed. Furthermore, the tone control part 23 functions as a controller that causes the image forming unit to form a measurement image, causes the sensor 10 to measure light reflected from a first area of the intermediate transfer member, causes the sensor 10 to measure light reflected from the measurement image, and causes the sensor 10 to measure the light reflected from a second area of the intermediate transfer member. Such a function of controlling the image forming part 11 and the sensor 10 may be implemented in a controller that is external to the tone control part 23, such as a CPU.

Figure 3:
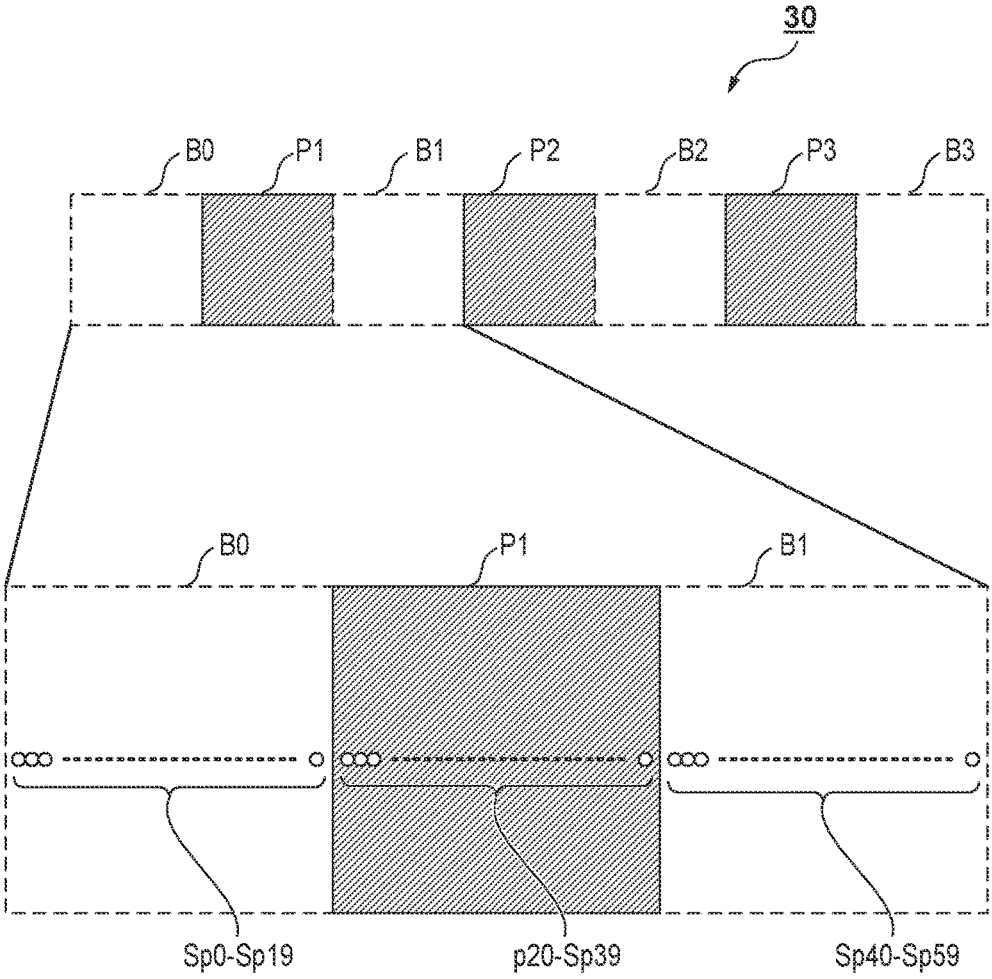
FIG. 3 is a diagram showing a test image.

FIG. 3 shows an example of a test image 30 formed on the surface of the intermediate transfer belt 5. The test image 30 is a toner image for performing tone correction and has a plurality of image patterns (patches) of respectively different tones, and the plurality of image patterns are formed on the surface of the intermediate transfer belt 5 at an interval from each other. According to FIG. 3, the test image 30 includes 10 patches of different tones for each of Y, M, C and K. In other words, 40 patches in total are formed on the surface of the intermediate transfer belt 5. The shape of the patches is arbitrary, and here is a square of 20 mm×20 mm in size. In FIG. 3, three patches $P_1$, $P_2$ and $P_3$ out of the 10 patches for yellow are shown. A non-image area, which is an area in which a toner image is not formed, is provided between each patch. For example, with regard to the patch $P_1$, a non-image area $B_0$ adjacent on the downstream side in the movement direction (rotation direction) of the intermediate transfer belt 5 is secured, and a non-image area $B_1$ adjacent on the upstream side of the patch $P_1$ is secured.

An enlargement of the non-image area $B_0$, the patch $P_1$ and the non-image area $B_1$ is also shown in FIG. 3. The amount of reflected light (also referred to as optical density) is detected by the sensor 10 at N positions (sampling points) for each of the non-image area $B_0$, the patch $P_1$ and the non-image area $B_1$. For example, the optical density is detected at sampling points Sp0 to Sp19 with regard to the non-image area $B_0$. The optical density is detected at sampling points Sp20 to Sp39 with regard to the patch $P_1$. The amount of reflected light and the optical density are correlated, and are thus interchangeable, and either may be used in the computations.

The sampling points may be absolute positions based on optical or magnetic marks (home positions) provided on the intermediate transfer belt 5, or may be relative positions based on the write timing of the test image. The time from the write timing of the YMCK test images until the test images arrive at the detection position (measurement position) of the sensor 10 is a fixed value, and is known. Therefore, the sampling points can be managed using a counter or a timer. The present embodiment employs the latter, which enables a mechanism for detecting marks to be omitted. The tone control part 23 holds respective sampling points and sampled values (values of optical density detected by the sensor 10) in a memory or the like in association with each other.

Figure 4A:
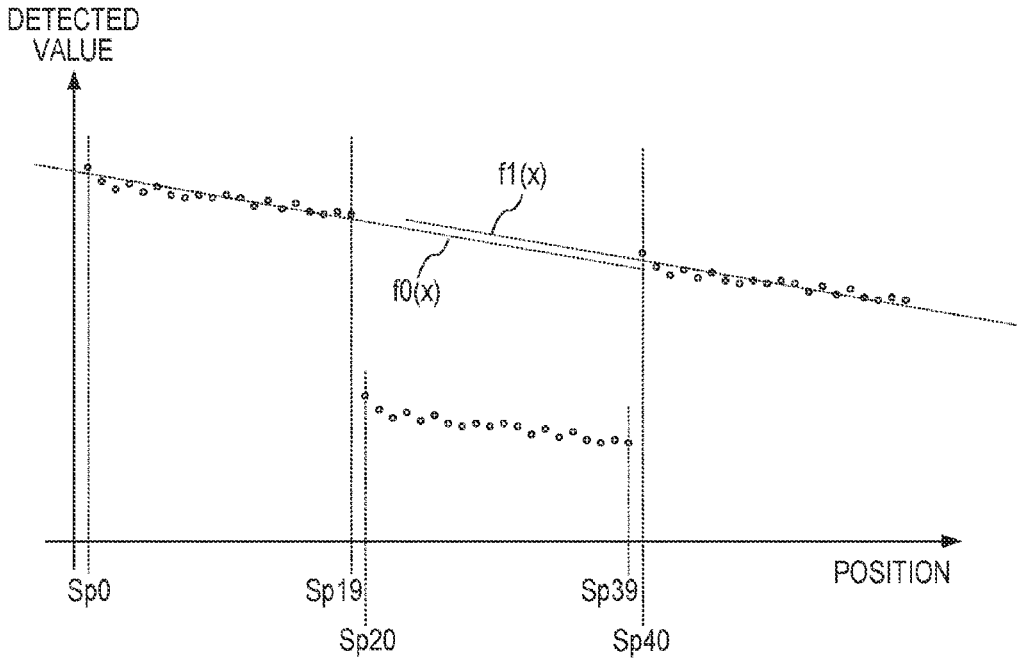
FIGS. 4A and 4B are diagrams showing an example of a detection result.
Figure 4B:
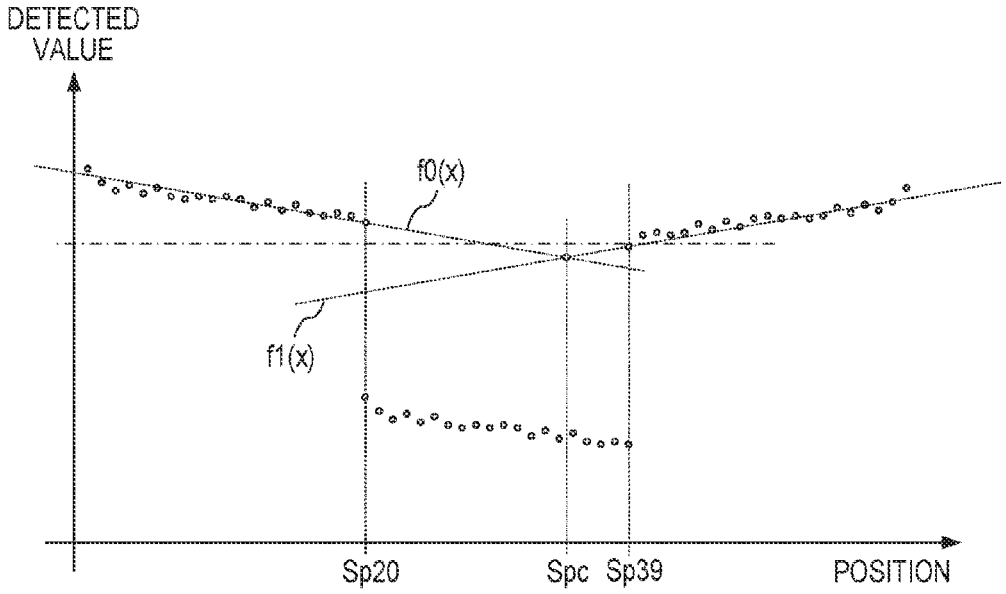

FIGS. 4A and 4B are figures showing an example of detection results for non-image areas and patches. The horizontal axis shows positions (sampling points) on the intermediate transfer belt 5. The vertical axis shows values detected by the sensor 10. In this example, the detected values for the patch $P_1$ are relatively low compared with the detected values for the non-image area $B_0$ and the non-image area $B_1$. Note that this relationship differs according to differences in the material and color of the non-image areas and in the detection system (specularly reflected light detection system, diffusely reflected light detection system) of the sensor 10. Note that, as above-mentioned, the influence of the reflectance of the non-image area where the patch $P_1$ is formed is included in the detected values of the patch $P_1$. Since the reflectance of the non-image area changes due to factors such as the usage and soiling of the intermediate transfer belt 5, the detected values of the patch $P_1$ needs to be corrected according to the state of the non-image areas. In particular, when a coating layer has been provided in the surface of the intermediate transfer belt 5, light reflected from the surface of the coating layer interferes with light that passes through the coating layer and is reflected by the base substrate of the intermediate transfer belt 5, and unevenness in the amount of reflected light in the non-image areas readily tends.

Although it is conceivable to detect the optical densities of the non-image areas throughout one turn of the intermediate transfer belt 5 and to hold the detected optical densities as a profile, problems such as discussed above arise in this case. In view of this, in the present embodiment, the tone control part 23 estimates the optical density (amount of reflected light) of the non-image area where the patch is formed using the detected value of the non-image area adjacent on the downstream side of the patch and the detected value of the non-image area adjacent on the upstream side. The tone control part 23 corrects the detected value for the patch using these estimated values. For example, the tone control part 23 reduces the influence of the reflected light of the non-image areas on the detected value of the specularly reflected light of the patch, by dividing the detected value of the optical density of the patch by the estimated value of the optical density of the non-image areas. When the detected value of a patch is given as $LP_i$ (i is a variable) and the detected value (estimated value) of a non-image area where the patch is detected is given as $LPB_i$, a corrected detected value $SIG_i$ is calculated with the following equation (1). Note that $LP_i$ may be the average value of detected values acquired at a plurality of sampling points (e.g.: 20 sampling points).

$$SIG_i=LP_i/LPB_i \quad (1)$$

Method of Estimating Optical Density of Non-Image Area and Method of Correcting Detected Value The optical density of the non-image area where a patch is formed cannot be directly detected because of the patch. In view of this, the tone control part 23 may acquire the estimated value $LPB_i$ of the optical density of the non-image area where an ith patch $P_1$ is formed based on the following equation (2).

$$LPB_i=(LB_{i-1}+LB_i)/2 \quad (2)$$

Here, $LB_{i-1}$ is the detected value of the amount of reflected light of an i−1th non-image area. $LB_i$ is the detected value of the optical density of an ith non-image area. As described above, an i−1th non-image area $B_{i-1}$ is adjacent on the downstream side of the patch $P_i$, and an ith non-image area $B_i$ is adjacent on the upstream side of the patch $P_i$.

If the sign of the gradient of the change in optical density of the i−1th non-image area $B_{i-1}$ and the sign of the gradient of the change in optical density of the ith non-image area $B_i$ are the same as shown in FIG. 4A, the estimated value $LPB_i$ of the optical density of the non-image area where the ith patch $P_i$ is formed is accurately obtained, by using the equation (2). However, if, as shown in FIG. 4B, the sign of the gradient of the change in optical density of the i−1th non-image area $B_{i-1}$ and the sign of the gradient of the change in optical density of the ith non-image area $B_i$ are not the same, the accuracy of the estimated value given by the equation (2) is low. Note that the gradients are the gradients of expressions $f_{i-1}(x)$ and $f_i(x)$ of approximate straight lines that are obtained from a plurality of sampled values. x is a variable showing a position (sampling point). In view of this, in the present embodiment, the estimation method is switched based on the sign of the gradient of the change in optical density of the i−1th non-image area $B_{i-1}$ and the sign of the gradient of the change in optical density of the ith non-image area $B_i$.

Figure 5A:
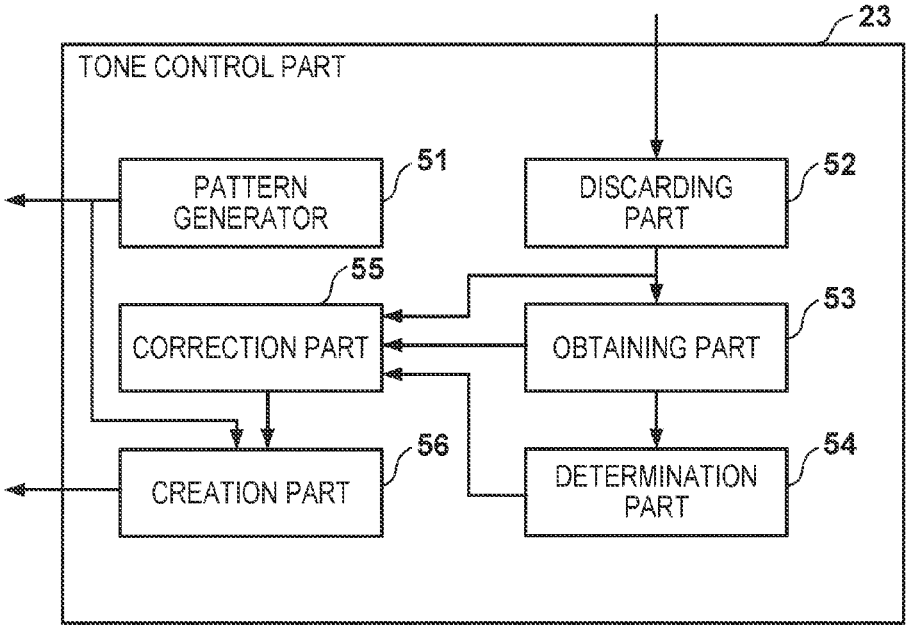
FIG. 5A is a block diagram of a tone control part.
Figure 5B:
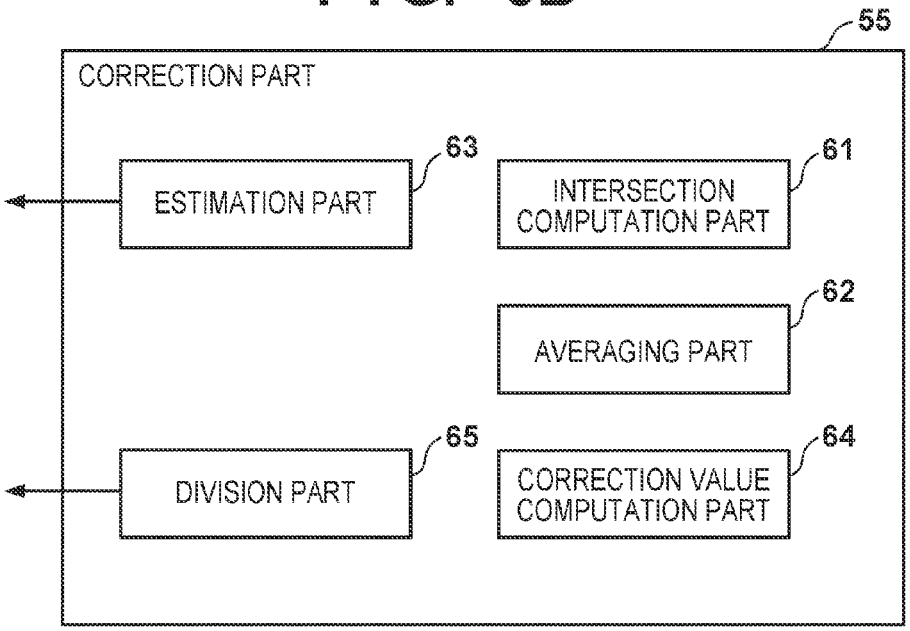
FIG. 5B is a block diagram of a correction part.
Figure 6:
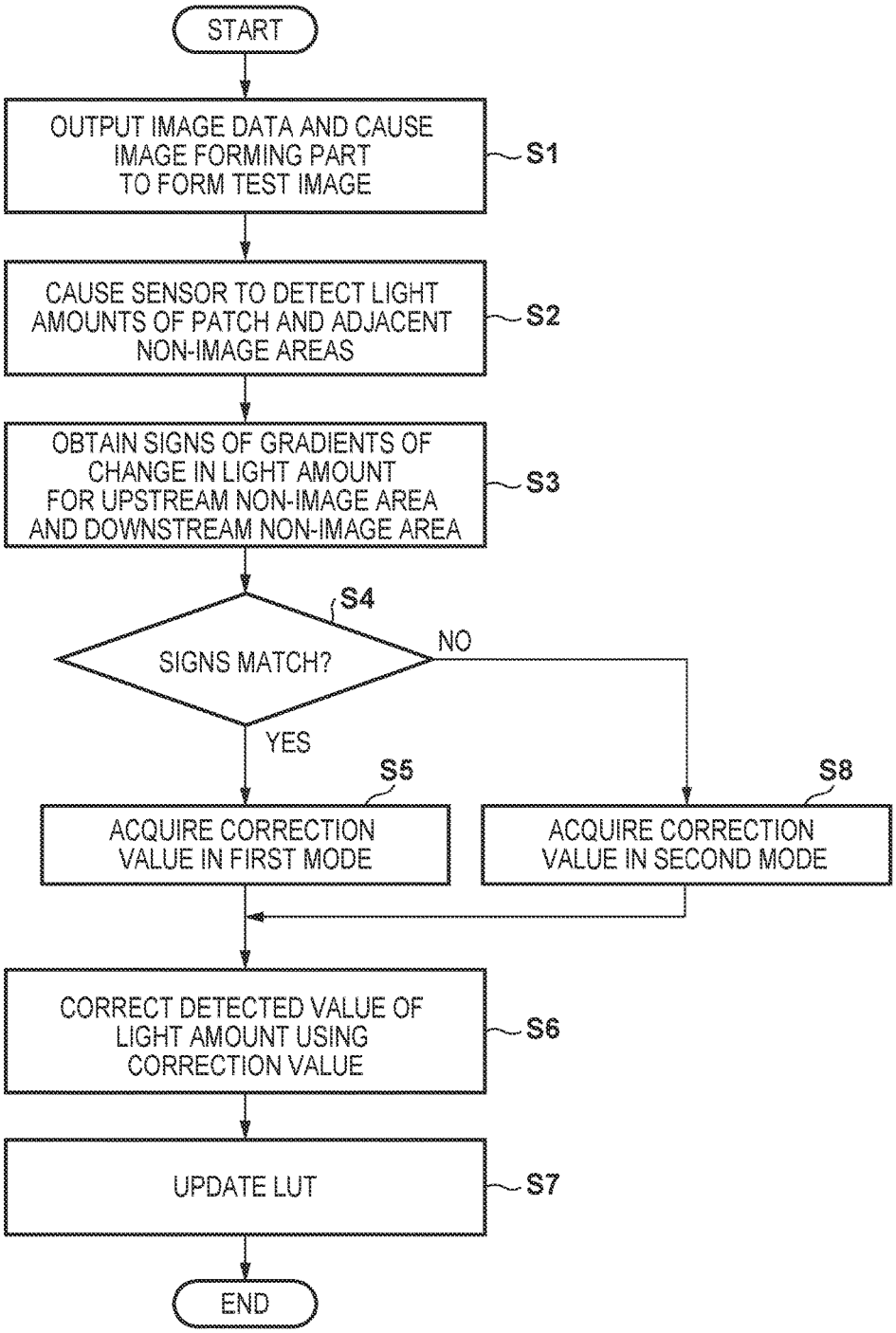
FIG. 6 is a flowchart showing processing for updating a look-up table.

Functions with which the tone control part 23 is provided and processing that the tone control part 23 executes will be described using FIGS. 5A, 5B and 6. FIG. 5A shows the functions with which the tone control part 23 is provided. The tone control part 23 may be realized by a CPU executing a program, or may be realized by an application-specific integrated circuit (ASIC) or a field-programmable gate array (FPGA). FIG. 5B shows the functions with which a correction part 55 is provided. FIG. 6 shows steps that are executed by the tone control part 23. The tone control part 23 is in charge of updating the above mentioned tone correction table (look-up table: LUT), and this update processing is also executable between sheets. This is because the optical densities of the non-image areas throughout one turn do not need to be obtained beforehand. Note that "between sheets" means the area between a preceding image and a following image on the intermediate transfer belt 5, when forming a plurality of images continuously.

At step S1, a pattern generator 51 of the tone control part 23 reads out from a memory or creates image data for forming the test image 30, and outputs the image data to the gamma part 22. The gamma part 22 outputs the input image data to the halftone processing part 24 without modification. In accordance with the image data output from the halftone processing part 24, the image forming part 11 forms the test image 30 on the intermediate transfer belt 5.

At step S2, the tone control part 23 causes the sensor 10 to detect the optical density of each patch $P_i$ of the test image 30 and the non-image areas $B_{i-1}$ and $B_i$ positioned before and after. The analog signal that is output by the light receiving element of the sensor 10 is converted into a digital value with an A/D converter, and input to the tone control part 23 as a detected value. Note that this digital value shows the amount of reflected light, and thus may be input to the tone control part 23 as a detected value after being converted into an optical density by a density conversion circuit or the like. A discarding part 52 is an optional unit, and may discard the detected value of one or more sampling points that are located near the boundary between the non-image areas B and the patch P, among the detected values of the plurality of sampling points. For example, the detected values of Sp0, Sp1, Sp18 and Sp19 may be discarded among the sampling points Sp0 to Sp19 of the non-image area $B_0$. This is because the toner of the patch P may have splashed and adhered at such sampling points located near the boundary with the patch P, and these sampling points could possibly be affected by the toner. Note that the detected values for one or more sampling points (e.g.: Sp20, Sp21, Sp38, Sp39) that are located near the boundary with the non-image areas B, among the detected values of the patch P, may also be discarded.

At step S3, an obtaining part 53 obtains the sign of the gradient of the change in optical density for the non-image area $B_{i-1}$ on the downstream side of the ith patch $P_i$ that is being focused on and the sign of the gradient of the change in optical density for the non-image area $B_i$ on the upstream side. For example, the obtaining part 53 linearly approximates the detected values of the 16 sampling points Sp2 to Sp17 for the non-image area $B_{i-1}$ on the downstream side, and acquires the linear expression $f_{i-1}(x)$ and the gradient thereof. Similarly, the obtaining part 53 linearly approximates the detected values of the 16 sampling points Sp42 to Sp57 for the non-image area $B_i$ on the upstream side, and acquires the linear expression $f_i(x)$ and the gradient thereof. The obtaining part 53 outputs the information on the gradients to a determination part 54. The linear expressions $f_i(x)$ and (x) are passed to the correction part 55.

At step S4, the determination part 54 determines whether the sign of the gradient for the non-image area $B_{i-1}$ on the downstream side and the sign of the gradient for the non-image area $B_i$ on the upstream side match. For example, the determination part 54 may multiply the gradient for the non-image area $B_{i-1}$ on the downstream side and the gradient for the non-image area Bi on the upstream side to acquire the product thereof, and may determine whether both signs match or do not match depending on whether the sign of the product is positive or negative. Note that the case where both signs match is shown in FIG. 4A, and the case where both signs do not match is shown in FIG. 4B. The determination part 54 outputs the determination result to the correction part 55. The correction part 55 advances the processing to step S5 (first mode) if both signs match, and advances the processing to step S8 (second mode) if both signs do not match. The correction part 55 thus functions as a selection unit that selects the computation mode of the correction value according to the gradients. Note that these gradients represent the state of the non-image area where the toner image is formed, and a correction value that depends on the state of the non-image area where the toner image is formed will be obtained by acquiring the correction value based on these gradients. More specifically, the correction part 55 functions as a selection unit that selects a mode that corresponds to a combination of the sign of the gradient of the optical density detected for the downstream area and the sign of the gradient of the optical density detected for the upstream area, from among a plurality of modes prepared in advance in order to determine the correction value for correcting the optical density for the toner image. This combination is the determination result of whether both signs match or not, and a mode that corresponds to this determination result or is suitable will be selected from among the plurality of modes. The determination result that the determination part 54 notifies to the correction part 55 will be information specifying or selecting a mode. Also, the correction part 55 functions as a selection unit that determines first information relating to a tendency of measurement results of a first area from a plurality of measurement results of the first area, determines second information relating to a tendency of measurement results of a second area from a plurality of measurement results of the second area, and selects a computational equation for computing a correction value of the measurement result of the measurement image from among a plurality of computational equations, based on the first information and the second information. The first area corresponds to an area in which a measurement image is not formed, on the upstream side of the measurement image in a conveyance direction in which the intermediate transfer member conveys an image. The second area corresponds to an area in which a measurement image is not formed, on the downstream side of the measurement image in the conveyance direction.

At step S5, the correction part 55 acquires a correction value in the first mode. In other words, a correction value computation part 64 of the correction part 55 functions as a determination unit that determines a correction value in accordance with the selected mode. The first mode is a mode in which the estimated value $LPB_i$ of the optical densities of the non-image area where the ith patch $P_i$ is formed is acquired with the estimation part 63 or the correction value computation part 64 using the above-mentioned equation (2), and $LPB_i$ is employed as the correction value. Note that an averaging part 62 acquires an average value $LB_{i-1}$ of Sp0 to Sp19 (or Sp2 to Sp17), and passes the average value to the estimation part 63 or the correction value computation part 64. Similarly, the averaging part 62 acquires an average value $LB_i$ of Sp40 to Sp59 (or Sp42 to Sp57), and passes the average value to the estimation part 63 or the correction value computation part 64. The estimation part 63 or the correction value computation part 64 acquires an average value of the average value $LB_{i-1}$ and the average value $LB_i$, and outputs this average value to a division part 65 as the correction value $LPB_i$. Also, the correction value computation part 64 functions as a generation unit that generates a correction value from the measurement results of the first area and the measurement results of the second area, based on a computational equation selected by the selection unit.

At step S6, the correction part 55 corrects the detected value $LP_i$ of the ith patch $P_i$ based on the correction value $LPB_i$, and acquires the corrected detected value $SIG_i$. For example, detected value $LP_1$ of the patch $P_1$ may be the average value of Sp20 to Sp39 (or Sp22 to Sp37) that is acquired with the averaging part 62. The correction part 55 acquires the detected value $SIG_i$ corrected using the equation (1), for example. In other words, the division part 65 may acquire the detected value $SIG_i$ corrected by dividing the detected value $LP_i$ by the correction value $LPB_i$. The correction part 55 outputs the detected value $SIG_i$ to the creation part 56. Note that steps S3 to S6 are repeatedly executed for all of the patches for YMCK included in the test image 30. In the case where 10 patches of respectively different tones exist for each of YMCK, the detected value $SIG_i$ is created for 40 patches in total.

At step S7, the creation part 56 updates the look-up table (LUT) based on the detected value $SIG_i$. As is well known, a look-up table for tone correction is a table for matching the tone properties of an input image and the tone properties of a toner image formed on a sheet. Therefore, the look-up table is created or updated such that the tone properties in the image data output from the pattern generator 51 and the tone properties acquired from the test image 30 match. For example, if the density (tone) in the image data of the patch $P_1$ is level 10 and the density acquired from the test image 30 is level 20, the look-up table is created so as to multiply the density of the input image data by 0.5. Also, for example, if the density in the image data of the patch $P_1$ is level 20 and the density acquired from the test image 30 is level 10, the look-up table is created so as to multiply the density of the input image data by 2. In other words, the look-up table is updated such that image data of level 5 is output when image data of level 10 is input, and image data of level 40 is output when image data of level 20 is input. If copying is executed using the updated look-up table, the toner image that is formed on a sheet will reproduce the tone of the original image. The look-up table thus is created or updated so as to have a function of reversing the ratio of the level of the input image data and the level of the output image data. Thus, the creation part 56 functions as an adjustment unit that adjusts the image forming conditions from the correction value generated by the generation unit and the measurement result of the measurement image.

When it is determined at step S4 that the sign of the gradient for the non-image area on the downstream side and the sign of the gradient for the non-image area $B_i$ on the upstream side do not match, the correction part 55 advances the processing to step S8. At step S8, the correction part 55 acquires a correction value in the second mode. In other words, the correction value computation part 64 of the correction part 55 functions as a generation unit that generates a correction value in accordance with the selected mode.

A method of acquiring a correction value in the second mode will be described with reference to FIG. 4B. An intersection computation part 61 of the correction part 55, based on the expressions $f_{i-1}(x)$ and $f_i(x)$ of the approximate straight lines that are obtained by the obtaining part 53, acquires coordinates (Spci, LPBci) of an intersection thereof. Furthermore, the estimation part 63 estimates an optical density $LPBa_i$ of the non-image area at the downstream end (Sp20 or Sp22) of the patch $P_i$ using the expression $f_{i-1}(x)$ of the approximate straight line representing the optical density detected for the downstream area. In other words, the estimation part 63 acquires $f_{i-1}$(Sp20) or $f_{i-1}$ (Sp22). The former is the value in the case where the discarding part 52 is not provided, and the latter is the value in the case where the discarding part 52 is provided. Furthermore, the estimation part 63 estimates an optical density $LPBb_i$ of the non-image area at the upstream end (Sp39 or Sp37) of the patch $P_i$ using the expression $f_i(x)$ of the approximate straight line representing the optical density detected for the upstream area. In other words, the estimation part 63 acquires $f_i$(Sp39) or $f_i$(Sp37). The former is the value in the case where the discarding part 52 is not provided, and the latter is the value in the case where the discarding part 52 is provided. The correction value computation part 64 acquires the correction value $LPB_i$ based on $LPBa_i$, $LPBb_i$ and $LPBc_i$. The correction value computation part 64 may acquire the correction value $LPB_i$ based on the following equation (3), for example. Thereafter, the correction part 55 advances the processing to step S6.

$$LPB_i=(LPBa_i+LPBb_i+LPBc_i)/3 \quad (3)$$

In the present embodiment, the optical density of a patch can thus be corrected according to the optical density of the non-image areas that are adjacent to the patch. Therefore, it is no longer necessary to create profiles of the optical densities of non-image areas throughout one turn, and the time required for tone correction is reduced. Since it is also not necessary to store profiles of the optical densities of non-image areas throughout one turn, the storage capacity of the memory required for correction is also reduced. Also, since tone correction is executable even between sheets, downtime of the image forming apparatus 100 is reduced. Also, since tone correction can be executed even when forming a plurality of images continuously, the tone reproduction of these plurality of images can be maintained with high accuracy.

Figure 7:
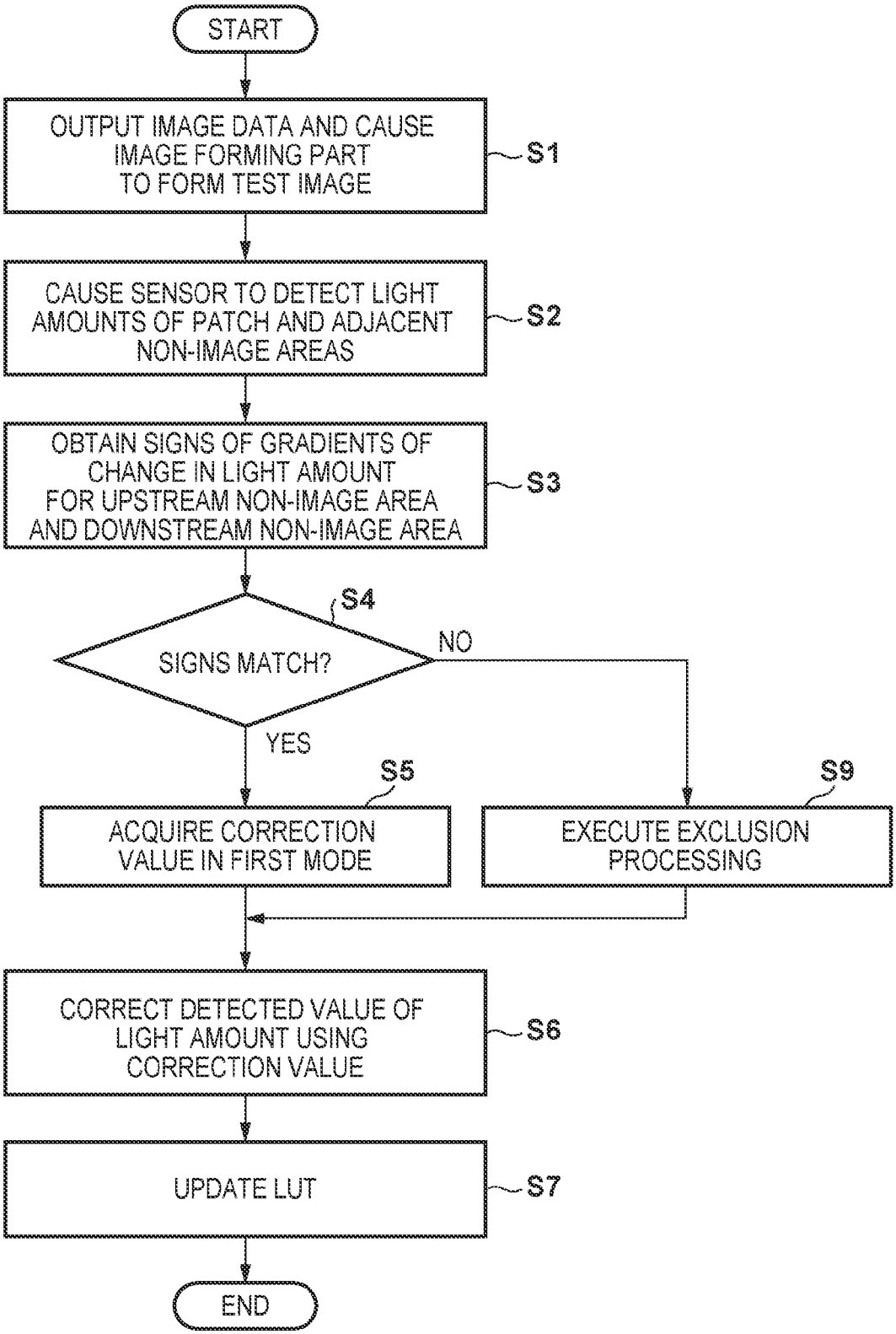
FIG. 7 is a flowchart showing processing for updating a look-up table.

In FIG. 6, the computation mode of the correction value was switched according to the sign of the gradient for the non-image area $B_{i-1}$ on downstream side and the sign of the gradient for the non-image area $B_i$ on the upstream side. However, as shown in FIG. 7, in the case where both signs do not match, step S9 may be executed instead of step S8. As described above, in the case where both signs do not match, the accuracy of the correction value obtained using the equation (2) is low. In other words, it will likely be difficult to accurately reduce the influence of the amount of reflected light of the non-image areas that is included in the detected value of the patch even when this correction value is used. In view of this, by the discarding part 52 discarding all detected values for patches, or in other words, tone levels, with respect to which both signs do not match, these values may be excluded from the detected values for updating the look-up table. The discarding part 52 or the determination part 54 notifies the creation part 56 as to the detection values of what patches, or in other words, tone values, have been excluded. For example, when the detected value of a patch whose tone level is 10 is discarded, the creation part 56 does not perform updating of the portion for the patch whose tone level is 10 within the look-up table. In other words, the creation part 56 updates the look-up table partially, using the detected values that have not been discarded. Since the look-up table will be updated using only detected values having relatively high accuracy, an improvement in the accuracy of tone correction can be achieved.

SUMMARY

As described above, the intermediate transfer belt 5 is an example of an image carrier. The image forming part 11 is an example of an image forming unit that forms a toner image (test image 30) for performing tone correction on the intermediate transfer belt 5. The sensor 10 functions as a detection unit that detects optical density. The above-mentioned LP, is the optical density of light reflected from the toner image formed on the intermediate transfer belt 5. $LB_{i-1}$ is the optical density of light reflected from a downstream area $B_{i-1}$, which is a non-image area, adjacent on the downstream side of the toner image in a rotation direction of the intermediate transfer belt 5, in which a toner image is not formed. $LB_i$ is the optical density of light reflected from an upstream area $B_i$, which is a non-image area, adjacent on the upstream side of the toner image in the rotation direction, in which a toner image is not formed. The obtaining part 53 functions as an obtaining unit that obtains the gradient of the optical density detected for the downstream area and the gradient of the optical density detected for the upstream area. The correction part 55 functions as a correction unit that acquires a correction value that depends on the state of the non-image area where the toner image is formed based on the gradient of the optical density detected for the downstream area and the gradient of the optical density detected for the upstream area, and corrects the optical density for the toner image based on the correction value. The creation part 56 functions as a creation unit or an update unit that creates a tone correction condition that is based on the image data used in order to form the toner image and the optical density of the toner image corrected by the correction part 55. In the present embodiment, the optical density of a patch can thus be corrected according to the optical density of the non-image areas that are adjacent to the patch. Thus, profiles of the optical densities of the non-image areas throughout one turn no longer need to be created, and the time required for tone correction is reduced. Since it is also not necessary to store profiles of the optical densities of the non-image areas throughout one turn, the storage capacity of the memory required for correction is also reduced. Also, since tone correction is executable even between sheets, the downtime of the image forming apparatus 100 is reduced. Also, since tone correction can be executed even when forming a plurality of images continuously, the tone reproduction of this plurality of images can be maintained with high accuracy. Note that the correction part 55 functions as a determination unit that determines a correction condition (e.g.: equation (2) or equation (3)) based on a first measurement result and a second measurement result. The first measurement result is a measurement result (e.g.: Sp0-Sp19) corresponding to light reflected from a first area on the upstream side of the measurement image in a conveyance direction in which the image carrier conveys the measurement image. The second measurement result is a measurement result (e.g.: Sp40-Sp59) corresponding to light reflected from a second area on the downstream side of the measurement image in the conveyance direction. The creation part 56 functions as a generation unit that generates a conversion condition, from the data included in the first measurement result, the data included in the second measurement result and the measurement result of the measurement image, based on the correction condition. Also, the correction part 55 may determine the correction condition according to the combination of the gradient of the optical density measured for the downstream area and the gradient of the optical density measured for the upstream area. The correction part 55 may be included in the creation part 56. The correction part 55 determines the correction value for correcting the optical density of the measurement image using the data included in the first measurement result, the data included in the second measurement result, and the correction condition. Furthermore, the correction part 55 functions as a correction unit that corrects the optical density, which is a measurement result of the measurement image, using this correction value. The creation part 56 may generate the conversion condition based on the image data used in order to form the measurement image and the optical density of the measurement image corrected using the correction value.

As described using FIG. 4A and FIG. 4B, the obtaining part 53 may linearly approximate the optical density from a plurality of positions in the downstream area and obtain the gradient of the optical density for the downstream area. Similarly, the obtaining part 53 may linearly approximate the optical density from a plurality of positions in the upstream area and obtain the gradient of the optical density for the upstream area. Also, the determination part 54 is an example of a determination unit that determines whether the sign of the gradient of the optical density for the downstream area and the sign of the gradient of the optical density for the upstream area are the same.

As described in relation to step S5, the averaging part 62 may acquire the average value of the optical density for the downstream area and the average value of the optical density for the upstream area, when the sign of the gradient of the optical density for the downstream area and the sign of the gradient of the optical density for the upstream area are the same. The estimation part 63 or the correction value computation part 64 functions as an estimation unit that estimates the optical density of the non-image area where the toner image is formed based on the average value of the optical density for the downstream area and the average value of the optical density for the upstream area. Also, the correction part 55 uses the optical density of the non-image areas estimated by the estimation part 63 or the correction value computation part 64 as the correction value. When the signs of both gradients thus match, the correction value will be acquired using a very simple computation.

As was described in relation to step S8, the correction part 55 may acquire the correction value using the second mode, when the sign of the gradient of the optical density for the downstream area and the sign of the gradient of the optical density for the upstream area are not the same. The intersection computation part 61 acquires the intersection of the approximate straight line representing the optical density detected for the downstream area and the approximate straight line representing the optical density detected for the upstream area. The estimation part 63 estimates the optical density of the non-image area at the downstream end of the toner image using the approximate straight line representing the optical density detected for the downstream area. Furthermore, the estimation part 63 estimates the optical density of the non-image area at the upstream end of the toner image using the approximate straight line representing the optical density detected for the upstream area. The intersection computation part 61 or the estimation part 63 estimates the optical density of the non-image areas at the intersection. The correction value computation part 64 acquires a correction value based on the optical density of the non-image area at the downstream end, the optical density of the non-image area at the upstream end, and the optical density of the non-image areas at the intersection. For example, the correction value computation part 64 may acquire the correction value using the equation (3). Thus, in the case where the accuracy of the correction value resulting from the equation (2) is low, the correction value may be acquired using the second mode. The accuracy of the correction value is thereby enhanced, and it becomes possible to update the look-up table accurately. In other words, an improvement in the accuracy of tone correction can also be achieved.

As described using the equation (3), the correction value computation part 64 may acquire the average value of the optical density of the non-image area at the downstream end, the optical density of the non-image area at the upstream end and the optical density of the non-image areas at the intersection, and the correction part 55 may use the average value as the correction value. It thereby becomes possible to accurately acquire the correction value by a comparatively simple computation, as compared with the equation (2), even in a case such as shown in FIG. 4B.

As was described in relation to step S9, the creation part 56 does not need to perform updating of the tone correction condition based on the optical density of the toner image corrected by the correction part 55 when the sign of the gradient of the optical density for the downstream area and the sign of the gradient of the optical density for the upstream area are not the same. In other words, the creation part 56 does not need to reflect, in the tone correction condition, the optical density of patches, among the plurality of patches, with respect to which it is determined as the sign of the gradient of the optical density for the downstream area and the sign of the gradient of the optical density for the upstream area are not the same. On the other hand, the creation part 56 reflects, in the tone correction condition, the optical density of patches with respect to which it is determined that the sign of the gradient of the optical density for the downstream area and the sign of the gradient of the optical density for the upstream area are the same. Thus, the look-up table is partially updated with regard to patches (tone levels) with respect to which it is determined that both signs are the same, and the look-up table is not partially updated with regard to the patches (tone levels) with respect to which it is determined that both signs are not the same. By employing such partial updating, accurate updating of the look-up table can be achieved.

As was described in relation to step S4, the determination part 54 may use the product of the gradient of the optical density for the downstream area and the gradient of the optical density for the upstream area. The determination part 54 may determine whether the sign of the gradient of the optical density for the downstream area and the sign of the gradient of the optical density for the upstream area are the same according to whether the sign of this product is positive or negative. The sign determination may be realized using a simple computation such as this.

As was described in relation to step S6, the division part 65 of the correction part 55 may correct the optical density for the toner image by dividing the optical density for the toner image by the correction value. Correction of detected values may be realized by a simple computation such as this. Detected values may be corrected using more complex functions.

As described in relation to the gamma part 22, the tone correction condition may be a tone correction table for correcting image data such that the tone of the image data and the tone of the toner image that is created using the image data are linear. Since such a tone correction table is often stored in the image forming apparatus 100 as a so-called look-up table, the present embodiment can be implemented in many image forming apparatuses.

As described using FIG. 3, the toner image for performing tone correction may have a plurality of image patterns of respectively different tones, and a plurality of image patterns may be formed on the surface of the image carrier at an interval from each other. Since non-image areas can thereby be secured on both sides of the patch, the present embodiment becomes easier to apply.

As described using FIGS. 3, 4A and the like, the discarding part 52 may discard detected values so as to not reflect at least the optical density detected at the nearest detection position to the toner image among the plurality of optical densities detected for the downstream area in the correction value. Similarly, the discarding part 52 may discard detected values so as to not reflect at least the optical density detected at the nearest detection position to the toner image among the plurality of optical densities detected for the upstream area in the correction value. This is because of the possibility of these non-image areas being affected by the splashing of toner from the patch. By not reflecting these optical density in the correction value, more accurate correction of the optical density of the patch can be possible.

The functions of the above-mentioned tone control part 23 may be executed by one processor, or the functions of the tone control part 23 may be executed by a plurality of processors. The functions of the discarding part 52, the obtaining part 53, the determination part 54, the correction part 55 and the creation part 56 may respectively be executed by one processor, or the functions of the discarding part 52, the obtaining part 53, the determination part 54, the correction part 55 and the creation part 56 may be executed by a plurality of processors. The functions of the intersection computation part 61, the averaging part 62, the estimation part 63, the correction value computation part 64 and the division part 65 may respectively be executed by one processor, or the functions of the intersection computation part 61, the averaging part 62, the estimation part 63, the correction value computation part 64 and the division part 65 may respectively be executed by a plurality of processors.

Also, the selection unit may be configured to generate first information relating to the change in light reflected from the first area based on first data and second data that are included in the plurality of measurement results of the first area, and to generate second information relating to the change in light reflected from the second area based on third data and fourth data that are included in the plurality of measurement results of the second area. The first data corresponds to the measurement result of light reflected from a first position that is included in the first area. The second data corresponds to the measurement result of light reflected from a second position included in the first area. The first position differs from the second position in the conveyance direction. The third data corresponds to the measurement result of light reflected from a third position included in the second area. The fourth data corresponds to the measurement result of light reflected from a fourth position included in the second area. The third position differs from the fourth position in the conveyance direction.

The plurality of computational equations may be also included in a first computational equation and a second computational equation. The first computational equation is a computational equation that calculates an average of the measurement result of the first area and the measurement result of the second area. The second computational equation is a computational equation that calculates a first approximate straight line based on the measurement result of the first area, calculates a second approximate straight line based on the measurement result of the second area, and calculates an average of the measurement result corresponding to the intersection of the first approximate straight line and the second approximate straight line, the measurement result of the first area and the measurement result of the second area.

The first information corresponds to the sign of the gradient of the first approximate straight line. The second information corresponds to the sign of the gradient of the second approximate straight line. If the sign of the gradient of the second approximate straight line and the sign of the gradient of the first approximate straight line are the same, the first computational equation is selected by the selection unit. If the sign of the gradient of the first approximate straight line and the sign of the gradient of the second approximate straight line are different, the second computational equation is selected by the selection unit.

The tone control part 23 is an example of a controller that causes an image forming unit to form a plurality of measurement images, causes a sensor to measure light reflected from a first area of the intermediate transfer member, causes a sensor to measure light reflected from the plurality of measured images, causes a sensor to measure light reflected from a second area of the intermediate transfer member, and causes a sensor to measure light reflected from a third area of the intermediate transfer member. The creation part 56 is an example of a generation unit that generates a tone correction condition based on the measurement result of the plurality of measurement images. The obtaining part 53, the correction part 55 and the like are an example of an obtaining unit that determines first information relating to a tendency of the measurement result of the first area from a plurality of measurement results of the first area, determines second information relating to a tendency of the measurement result of the second area from a plurality of measurement results of the second area, and obtains third information relating to a tendency of the measurement result of the third area from a plurality of measurement results of the third area. The creation part 56 may control, based on the first information and the second information, whether a tone correction condition is generated based on the measurement result of a first measurement image formed between the first area and the second area, in a conveyance direction in which the intermediate transfer member conveys a plurality of measurement images. The creation part 56 may control, based on the second information and the third information, whether a tone correction condition is generated based on the measurement result of a second measurement image formed between the second area and the third area, in the conveyance direction. The first area corresponds to an area, on the upstream side of the first measurement image in a conveyance direction in which the intermediate transfer member conveys images, in which other measurement images included in the plurality of measurement images are not formed. The second area corresponds to an area, between the first measurement image and the second measurement image in the conveyance direction, in which other measurement images included in the plurality of measurement images are not formed. The third area corresponds to an area, on the downstream side of the second measurement image in the conveyance direction, in which other measurement images included in the plurality of measurement images are not formed. Also, the first information corresponds to the sign of the gradient of the first approximate straight line that is calculated from the measurement result of the first area. The second information corresponds to the sign of the gradient of the second approximate straight line that is calculated from the measurement result of the second area. The third information corresponds to the sign of the gradient of the third approximate straight line that is calculated from the measurement result of the third area.

The creation part 56 generates a tone correction condition, without using the first measurement image, in the case where the sign of the gradient of the first approximate straight line and the sign of the gradient of the second approximate straight line are different. The creation part 56 generates a tone correction condition, without using the second measurement image, in the case where the sign of the gradient of the second approximate straight line and the sign of the gradient of the third approximate straight line are different. The creation part 56 generates a tone correction condition based on the measurement result of the first measurement image and the measurement result of the second measurement image, in the case where the sign of the gradient of the first approximate straight line, the sign of the gradient of the second approximate straight line and the sign of the gradient of the third approximate straight line are the same. Note that the density of the first measurement image and the density of the second measurement image are different.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-205839, filed Oct. 19, 2015 which is hereby incorporated by reference herein in its entirety.

What is claimed is:

1. An image forming apparatus comprising:

an image forming unit configured to form an image;

an intermediate transfer member configured to have the image transferred thereto and to convey the image;

a sensor configured to measure light reflected from the intermediate transfer member;

a controller configured to control the image forming unit to form a measurement image, to control the sensor to measure light reflected from a first area of the intermediate transfer member, to control the sensor to measure light reflected from the measurement image, and to control the sensor to measure light reflected from a second area of the intermediate transfer member;

a selection unit configured to determine, from a plurality of measurement results of the first area, first information relating to a tendency of the measurement results of the first area, to determine, from a plurality of measurement results of the second area, second information relating to a tendency of the measurement results of the second area, and to select a computational equation for computing a correction value of a measurement result of the measurement image from among a plurality of computational equations, based on the first information and the second information;

a generation unit configured to generate the correction value from the measurement results of the first area and the measurement results of the second area, based on the computational equation selected by the selection unit; and an adjustment unit configured to adjust an image forming condition from the correction value generated by the generation unit and the measurement result of the measurement image, wherein the first area corresponds to an area, on an upstream side of the measurement image with respect to a conveyance direction in which the intermediate transfer member conveys the image, in which the measurement image is not formed, and the second area corresponds to an area, on a downstream side of the measurement image with respect to the conveyance direction, in which the measurement image is not formed.

2. The image forming apparatus according to claim 1, wherein the selection unit is configured to generate the first information relating to a change in the light reflected from the first area based on first data and second data that are included in the plurality of measurement results of the first area, and to generate the second information relating to a change in the light reflected from the second area based on third data and fourth data that are included in the plurality of measurement results of the second area, the first data corresponds to a measurement result of light reflected from a first position included in the first area, the second data corresponds to a measurement result of light reflected from a second position included in the first area, the first position differs from the second position with respect to the conveyance direction, the third data corresponds to a measurement result of light reflected from a third position included in the second area, the fourth data corresponds to a measurement result of light reflected from a fourth position included in the second area, and the third position differs from the fourth position with respect to the conveyance direction.

3. The image forming apparatus according to claim 1, wherein the plurality of computational equations include a first computational equation and a second computational equation, the first computational equation is a computational equation that calculates an average of the measurement results of the first area and the measurement results of the second area, and the second computational equation is a computational equation that calculates a first approximate straight line based on the measurement results of the first area, calculates a second approximate straight line based on the measurement results of the second area, and calculates an average of a measurement result corresponding to an intersection of the first approximate straight line and the second approximate straight line, the measurement results of the first area and the measurement results of the second area.

4. The image forming apparatus according to claim 3, wherein the first information corresponds to a sign of a gradient of the first approximate straight line, the second information corresponds to a sign of a gradient of the second approximate straight line, if the sign of the gradient of the first approximate straight line and the sign of the gradient of the second approximate straight line are the same, the first computational equation is selected by the selection unit, and if the sign of the gradient of the first approximate straight line and the sign of the gradient of the second approximate straight line are different, the second computational equation is selected by the selection unit.

5. The image forming apparatus according to claim 1, wherein the image forming condition is a tone correction condition for correcting a tone property of the image to be formed by the image forming unit.

6. The image forming apparatus according to claim 5, wherein the tone correction condition is a tone correction table.

7. An image forming apparatus comprising:

a conversion unit configured to convert image data based on a tone correction condition, an image forming unit configured to form an image based on the image data converted by the conversion unit;

an intermediate transfer member configured to have the image transferred thereto and to convey the image;

a sensor configured to measure light reflected from the intermediate transfer member;

a controller configured to control the image forming unit to form a plurality of measurement images, to control the sensor to measure light reflected from the plurality of measurement images, to control the sensor to measure light reflected from a first area of the intermediate transfer member, to control the sensor to measure light reflected from a second area of the intermediate transfer member, and to control the sensor to measure light reflected from a third area of the intermediate transfer member;

a generation unit configured to generate the tone correction condition based on a measurement result of the plurality of measurement images; and an obtaining unit configured to determine, from a plurality of measurement results of the first area, first information relating to a tendency of the measurement results of the first area, to determine, from a plurality of measurement results of the second area, second information relating to a tendency of the measurement results of the second area, and to determine, from a plurality of measurement results of the third area, third information relating to a tendency of the measurement results of the third area, wherein the generation unit is configured to control, based on the first information and the second information, whether the tone correction condition is generated based on a measurement result of a first measurement image formed between the first area and the second area, with respect to a conveyance direction in which the intermediate transfer member conveys the plurality of measurement images, the generation unit is configured to control, based on the second information and the third information, whether the tone correction condition is generated based on a measurement result of a second measurement image formed between the second area and the third area, with respect to the conveyance direction, the first area corresponds to an area, on an upstream side of the first measurement image with respect to the conveyance direction, in which other measurement images included in the plurality of measurement images are not formed, the second area corresponds to an area, between the first measurement image and the second measurement image with respect to the conveyance direction, in which other measurement images included in the plurality of measurement images are not formed, and the third area corresponds to an area, on a downstream side of the second measurement image with respect to the conveyance direction, in which other measurement images included in the plurality of measurement images are not formed.

8. The image forming apparatus according to claim 7, wherein the first information corresponds to a sign of a gradient of a first approximate straight line calculated from the measurement results of the first area, the second information corresponds to a sign of a gradient of a second approximate straight line calculated from the measurement results of the second area, and the third information corresponds to a sign of a gradient of a third approximate straight line calculated from the measurement results of the third area.

9. The image forming apparatus according to claim 8, wherein the generation unit is configured to generate the tone correction condition without using the first measurement image, in a case where the sign of the gradient of the first approximate straight line and the sign of the gradient of the second approximate straight line are different, and the generation unit is configured to generate the tone correction condition without using the second measurement image, in a case where the sign of the gradient of the second approximate straight line and the sign of the gradient of the third approximate straight line are different.

10. The image forming apparatus according to claim 9, wherein the generation unit is configured to generate the tone correction condition based on the measurement result of the first measurement image and the measurement result of the second measurement image, in a case where the sign of the gradient of the first approximate straight line, the sign of the gradient of the second approximate straight line, and the sign of the gradient of the third approximate straight line are the same.

11. The image forming apparatus according to claim 7, wherein a density of the first measurement image and a density of the second measurement image are different.

* * * * *